US006574444B2

(12) United States Patent
Uehara et al.

(10) Patent No.: US 6,574,444 B2
(45) Date of Patent: Jun. 3, 2003

(54) DEVELOPING APPARATUS WHEREIN SEAL-INFLICTED DAMAGE TO AN END EDGE OF A DEVELOPING ROLLER IS PREVENTED

(75) Inventors: Shinji Uehara, Susono (JP); Tetsuya Kobayashi, Numazu (JP); Yasuyuki Ishii, Mishima (JP); Tsuyoshi Nakagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/772,977

(22) Filed: Jan. 31, 2001

(65) Prior Publication Data

US 2001/0053296 A1 Dec. 20, 2001

(30) Foreign Application Priority Data

Feb. 4, 2000 (JP) ..... 2000-032827

(51) Int. Cl.[7] ..... G03G 15/08
(52) U.S. Cl. ..... 399/103; 399/105
(58) Field of Search ..... 399/102, 103, 399/105

(56) References Cited

U.S. PATENT DOCUMENTS 5,134,960 A * 8/1992 Shirai ..... 399/105
5,283,616 A * 2/1994 Numagami et al.
5,488,462 A * 1/1996 Ishikawa et al. ..... 399/103
5,502,547 A * 3/1996 Shirai ..... 399/102
5,790,923 A * 8/1998 Oguma et al. ..... 399/105 X
6,070,027 A * 5/2000 Kawai et al. ..... 399/103
6,144,820 A 11/2000 Ishii et al. ..... 399/90
6,181,897 B1 * 1/2001 Kawai ..... 399/103
6,299,979 B1 * 5/2001 Ishii et al.
6,266,500 B1 * 7/2001 Numagami et al. ..... 399/103 X

FOREIGN PATENT DOCUMENTS

JP 4-298762 * 10/1992

* cited by examiner

*Primary Examiner*—Susan S. Y. Lee
(74) *Attorney, Agent, or Firm*—Fitzpatrick, Cella, Harper & Scinto

(57) ABSTRACT

A developing apparatus includes a developing container for containing a developer therein. A developing carrying member, provided in an opening portion of the developing container, for developing an electrostatic image on an image bearing member, the developer carrying member having a rubber layer and a surface layer on the rubber layer. A seal member is provided in the opening portion for preventing leakage of the developer from an end portion of the opening portion. The seal member provided in the opening portion for preventing leakage of the developer from an end portion of the opening portion, wherein the seal member is in contact with the surface layer except for an end edge thereof.

8 Claims, 6 Drawing Sheets

DEVELOPING APPARATUS WHEREIN SEAL-INFLICTED DAMAGE TO AN END EDGE OF A DEVELOPING ROLLER IS PREVENTED

BACKGROUND OF THE INVENTION

Field of the Invention

This invention relates to a developing apparatus used in an image forming apparatus such as a copier or a printer using the electrophotographic method or the electrostatic recording method to develop an electrostatic image on an image bearing member.

Related Background Art

In an image forming apparatus using the electrophotographic method, it has heretofore been practiced to visualize an electrostatic latent image formed on an image bearing member as a toner image by a developing apparatus.

As examples of such a developing apparatus, there have been proposed various dry type monocomponent developing apparatuses. Also, when visualizing the electrostatic latent image, a developer carrying member is adopted to carry a developer to the image bearing member such as a photosensitive drum.

There has heretofore been proposed a contact monocomponent developing method of effecting development by using an electrically semiconductive developing roller or a developing roller having a dielectric layer formed on the surface thereof as the developer carrying member, and pressing it against the surface layer of a photosensitive body.

In such a system, the developing roller contacts with the surface of the photosensitive body and is rotated to thereby effect development and therefore, an elastic material is generally used for the developing roller. Also, functions required of the developing roller include that a necessary developing nip can be obtained, that the developing roller has a sufficient recovering property for a compressive force to the contact, that a toner on the developing roller obtains a desired charging polarity and charging amount, that the surface of the developing roller is excellent in the releasing property with respect to a developer (hereinafter referred to also as the toner) and the toner does not film on the surface of the roller, etc.

Therefore, as the construction of the developing roller, use is generally made of such a multilayer construction that satisfies functions required of the vicinity of the surface of the developing roller and functions required of the interior of the developing roller.

A developing roller of such a multilayer construction generally has a surface layer formed on an elastic layer as an underlying layer by dip coating, roll coating or the like.

Also, as compared with a magnetic developing apparatus which uses a magnetic toner and can easily hold the toner on the surface of a developing sleeve by the action of a magnetic field, in a developing apparatus using a non-magnetic toner as a developer, a magnetic attracting force cannot be used and therefore, it becomes difficult to prevent the leakage of the toner out of the developing apparatus.

Here, the developing apparatus will be described with reference to FIG. 8 of the accompanying drawings. FIG. 8 shows the structure of the developing apparatus, and is a view of a developing container 24 as it is seen from the opening portion side thereof.

A developing roller 25 is disposed in the opening portion of the developing container 24. This developing roller 25 is rotated in the direction of arrow B. Also, the developing roller is supplied with a toner by an elastic roller (not shown) located upstream of the position of the contact portion between the developing roller 25 and an elastic blade 27 with respect to the direction of rotation and contacting with the developing roller 25.

The toner supplied to the developing roller 25 is carried to the contact portion between the elastic blade 27 and the developing roller 25 with the rotation of the developing roller 25 and is made into a thin layer.

Thereafter, the toner is carried onto a photosensitive body (not shown) which is an image bearing member, whereby the development of an electrostatic latent image is effected.

Also, a flexible seal member 26 lightly contacting with the developing roller 25 is provided in a toner collecting portion (the downstream side of the developing roller with respect to the direction of rotation thereof) which is the lower portion of the developing container 24, to thereby permit the passage of the toner unused for development and prevent the toner in the developing container 24 from leaking out of the lower portion of the developing container 24.

Further, end portion seal members 29 formed of a fibrous material such as woolen felt or polytetrafluoroethylene (herein referred to as PTFE) pile or a foamed material such as polyurethane foam or sponge rubber are provided in the gaps between the opposite end portions of the developing roller 25 and the opening portion of the developing container 24 to thereby prevent the leakage of the toner from between the developing container 24 and the lengthwisely opposite end portions of the developing roller 25.

However, the developing roller having its surface layer formed by dip coating, roll coating or the like as described above is liable to cause an unevenness of the coat on the end portions of the surface layer during the formation of the surface layer.

Therefore, for example, in the outermost peripheral portion of the end surfaces of the elastic layer, the surface layer cannot be stably applied thereto or conversely the surface layer becomes thick. Also when the opposite end portions of the surface layer of the developing roller are lengthwisely inside the elastic layer, it is sometimes the case that when the surface layer is to be applied by roll coating or the like, the surface layer cannot be sufficiently applied at the beginning and end of the application.

When by the use of such a developing roller, the developing operation is repeated a number of times by the conventional developing apparatus as shown in FIG. 8, the end portions of the surface layer of the developing roller 25 have their surface layer peeled off by long-period use because the frictional contact thereof with the end portion seal members 29 is repeated, and with it as an occasion, the peeling-off of the surface layer of the developing roller 25 progresses to the lengthwisely central portion of the developing roller 25.

This state will now be described with reference to FIG. 9 of the accompanying drawings. As shown in FIG. 9, the peeling-off 90 at the end portions of the developing roller 25 progresses to the central portion of the developing roller 25.

As the result, gaps are formed between the opening portion of the developing container 24 and the end portion seal members 29 and the sealing property of the seal members to the leakage of the toner is reduced.

SUMMARY OF THE INVENTION

It is an object of the present invention to provide a developing apparatus in which the peeling-off of the surface layer of a developer carrying member is prevented.

It is another object of the present invention to provide a developing apparatus in which the leakage of a developer from the end portions of the apparatus is prevented.

It is still another object of the present invention to provide a developing apparatus comprising:

a developing container for containing a developer therein;

a developer carrying member provided in an opening portion of the developing container, the developer carrying member developing an electrostatic image on an image bearing member; and a seal member provided in the opening portion for preventing leakage of the developer from an end portion of the opening portion;

the seal member contacting with the end portion of the developer carrying member except for an end edge thereof.

Further objects of the present invention will become apparent from the following description.

DETAILED DESCRIPTION OF THE PREFERRED EMBODIMENTS

Figure 1:
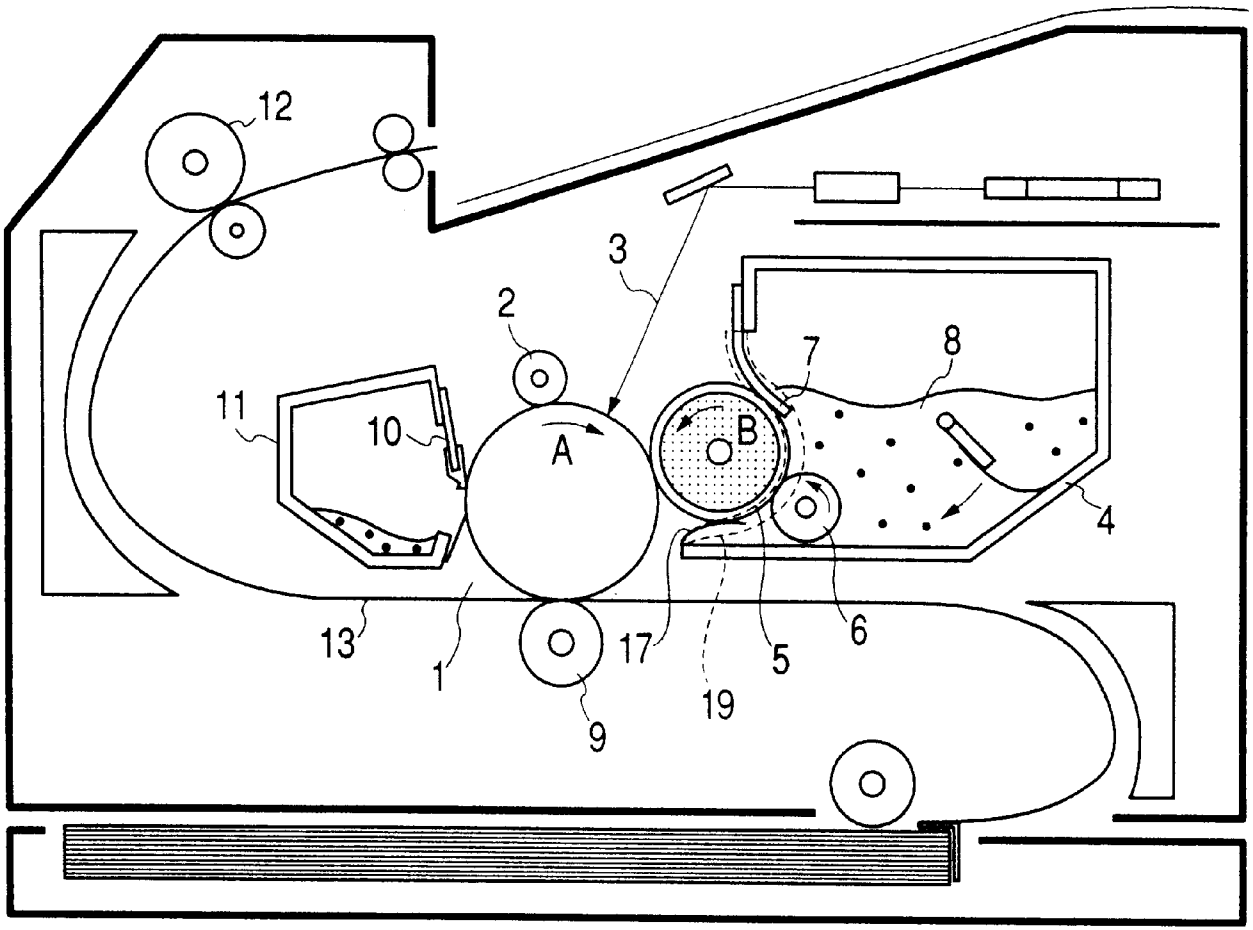
FIG. 1 is a cross-sectional view of an image forming apparatus provided with a first embodiment of a developing apparatus according to the present invention.

Some preferred embodiments of this invention will hereinafter be described in detail by way of example with reference to the drawings. However, the dimensions, materials, shapes, relative disposition, etc. of constituent parts described in these embodiments, unless otherwise specifically described, are not intended to restrict the scope of this invention thereto.

Also, in the following drawings, members similar to the members shown in the drawings used in the description of the prior art and the members shown in the drawings already described are given the same reference numerals.

First Embodiment of the Developing Apparatus

Figure 2:
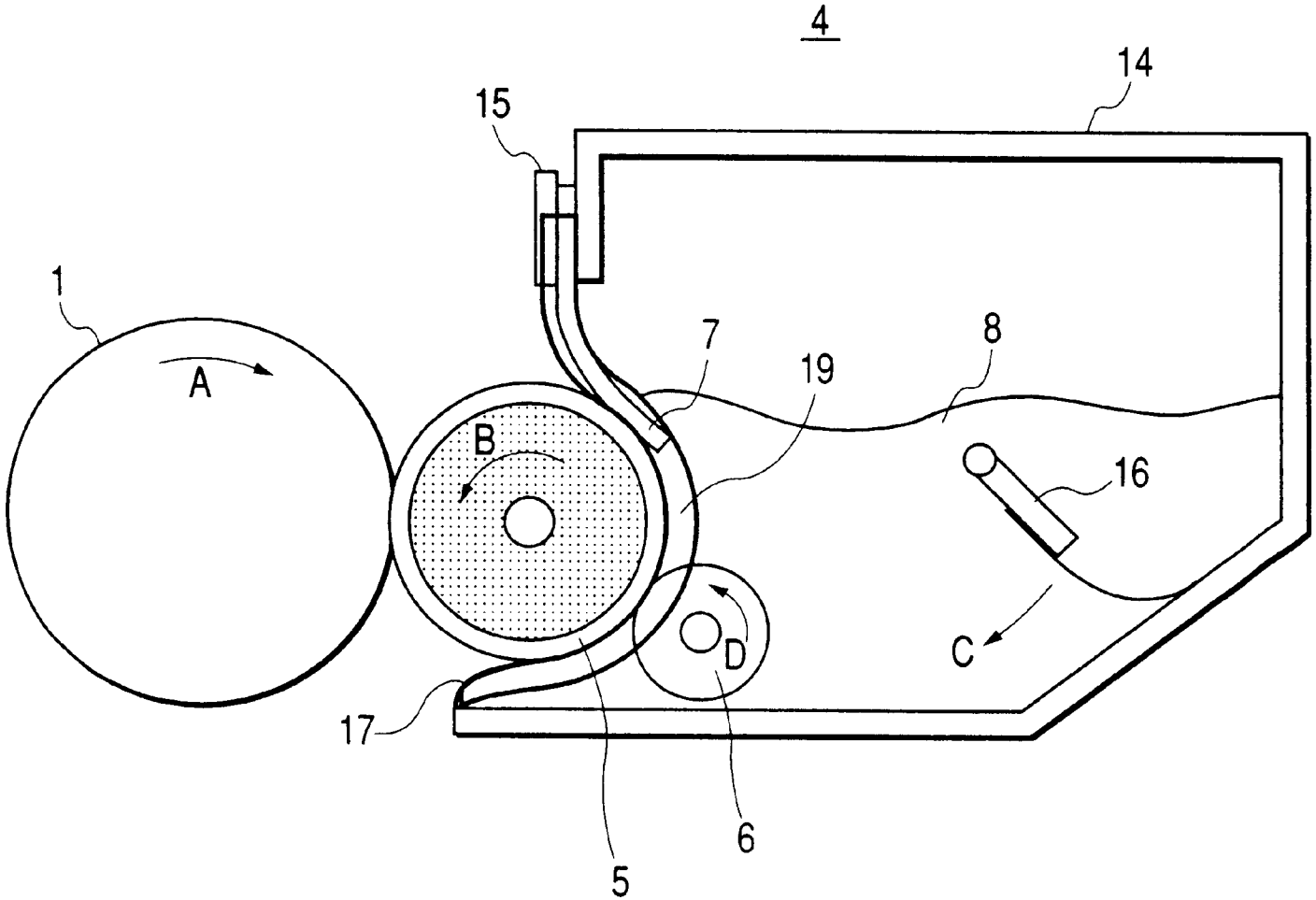
FIG. 2 is a cross-sectional view of the developing apparatus shown in FIG. 1.

An image forming apparatus provided with a first embodiment of a developing apparatus according to the present invention will first be described with reference to FIGS. 1 and 2. FIG. 1 shows a cross-sectional view of the image forming apparatus provided with the first embodiment of the developing apparatus according to the present invention, and FIG. 2 shows a cross-sectional view of the developing apparatus shown in FIG. 1.

Referring to FIG. 1, a photosensitive drum 1 on which a latent image is to be formed is rotated in the direction of arrow A, and is uniformly charged by a charging apparatus 2 for charging the photosensitive drum 1, and an electrostatic latent image is formed on the surface thereof by a laser beam 3 from an exposing unit for writing the electrostatic latent image on the photosensitive drum 1.

This electrostatic latent image is developed and visualized as a toner image by a developing apparatus 4 disposed in proximity to the photosensitive drum 1.

In the present embodiment, so-called reversal developing which forms a toner image on an exposed portion is effected.

The visualized toner image on the photosensitive drum 1 is transferred to paper 13 which is a recording medium by a transferring roller 9.

Any untransferred toner not transferred but residual on the photosensitive drum 1 is scraped off by a cleaning blade 10, and is contained in a waste toner containing container 11, and the thus cleaned photosensitive drum 1 repeats the above-described action and repetitively effects image formation.

On the other hand, the paper 13 to which the toner image has been transferred is subjected to the fixing process by a fixing apparatus 12 and is discharged out of the apparatus and thus, the printing operation is completed.

The developing apparatus 4 according to the present embodiment will be further described with reference to FIG. 2. In FIG. 2, the reference numeral 14 designates a developing container as the developer container of the present invention containing therein a non-magnetic toner 8 as the developer of the present invention which is a monocomponent developer.

This developing apparatus 4 is provided with a developing roller 5 as the developer carrying member of the present invention located in an opening portion extending lengthwisely in the developing container 14 and disposed in opposed relationship with the photosensitive drum 1, and is adapted to develop and visualize the electrostatic latent image on the photosensitive drum 1.

The developing roller 5 is in contact with the photosensitive drum 1 with a contact width. The specific developing operation is such that the non-magnetic toner 8 in the developing container 14 is sent toward an elastic roller 6 with the rotation of an agitating member 16 in the direction of arrow C.

Next, by the elastic roller 6 being rotated in the direction of arrow D, the non-magnetic toner 8 is carried to the vicinity of the developing roller 5, and in the contact portion between the developing roller 5 and the elastic roller 6, the non-magnetic toner 8 carried on the elastic roller 6 frictionally contacts with the developing roller 5 and is thereby subjected to frictional charging, and adheres onto the developing roller 5.

Thereafter, with the rotation of the developing roller 5 in the direction of arrow B, the non-magnetic toner 8 is sent under the pressure contact of an elastic blade 7, and is formed into a thin layer on the developing roller 5.

The layer of the non-magnetic toner 8 formed as the thin layer on the developing roller 5 is uniformly carried to a developing portion which is a portion opposed to the photosensitive drum 1.

In this developing portion, the layer of the non-magnetic toner formed as the thin layer on the developing roller 5 develops the electrostatic latent image on the photosensitive drum 1 as a toner image by a DC voltage applied to the developing roller 5.

Any undeveloping toner not consumed in the developing portion is collected from the lower portion of the developing roller 5 with the rotation of the developing roller 5.

A seal member 17 comprising a flexible sheet is provided in this collecting portion and permits the passage of the undeveloping toner into the developing container 14 and also prevents the non-magnetic toner 8 in the developing container 14 from leaking from the lower portion of the developing roller 5.

This collected undeveloping toner on the developing roller 5 is scraped off from the surface of the developing roller 5 in the contact portion between the elastic roller 6 and the developing roller 5 and at the same time, fresh toner is supplied onto the developing roller 5 by the rotation of the elastic roller 6, and the aforedescribed action is repeated.

Also, in the present embodiment, in order to prevent the leakage of the non-magnetic toner 8 from the vicinity of the end portions of the developing roller 5 to the outside, i.e., the so-called toner leakage, end portion seal members 19 as the seal members of the present invention are discretely provided near the end portions of the developing roller. In FIG. 2, however, for the facility of description, the end portion seal members 19 are seen through and shown.

Figure 7A:
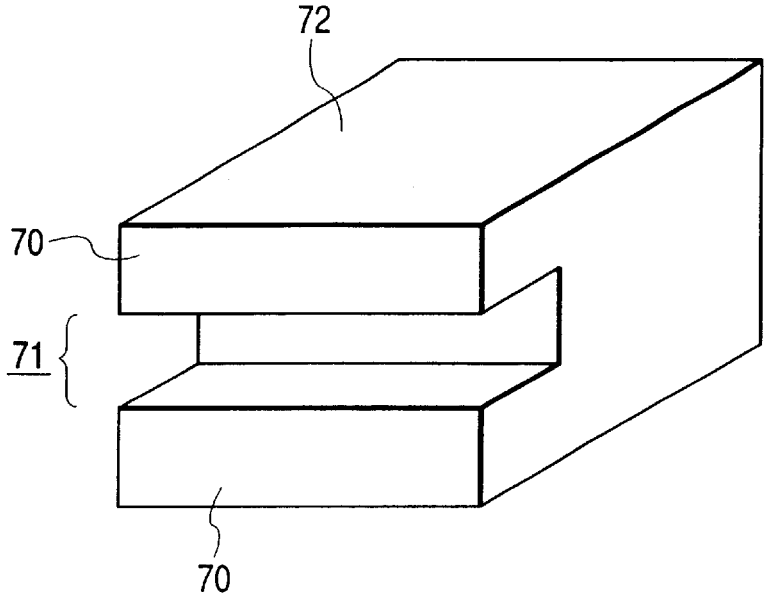
FIGS. 7A and 7B are conceptional views of the developing apparatus according to the present invention.
Figure 7B:
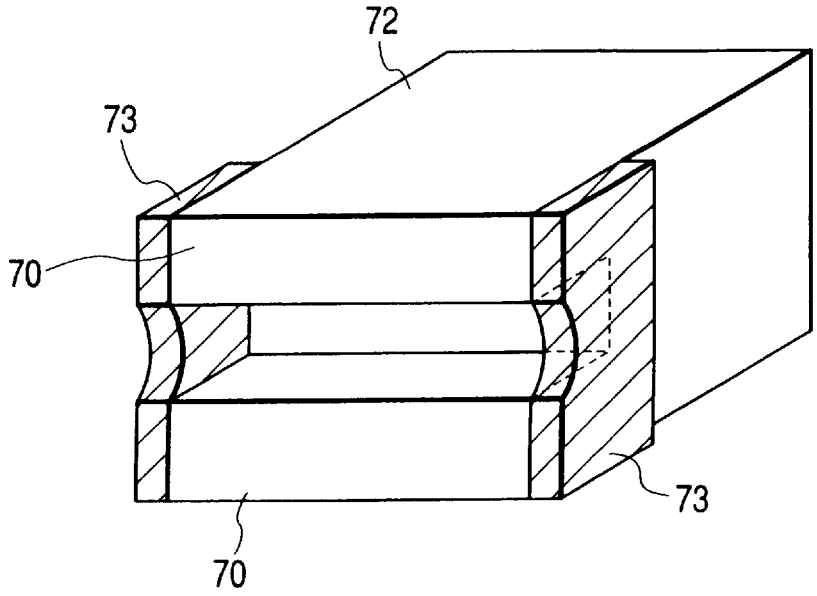
Figure 8:
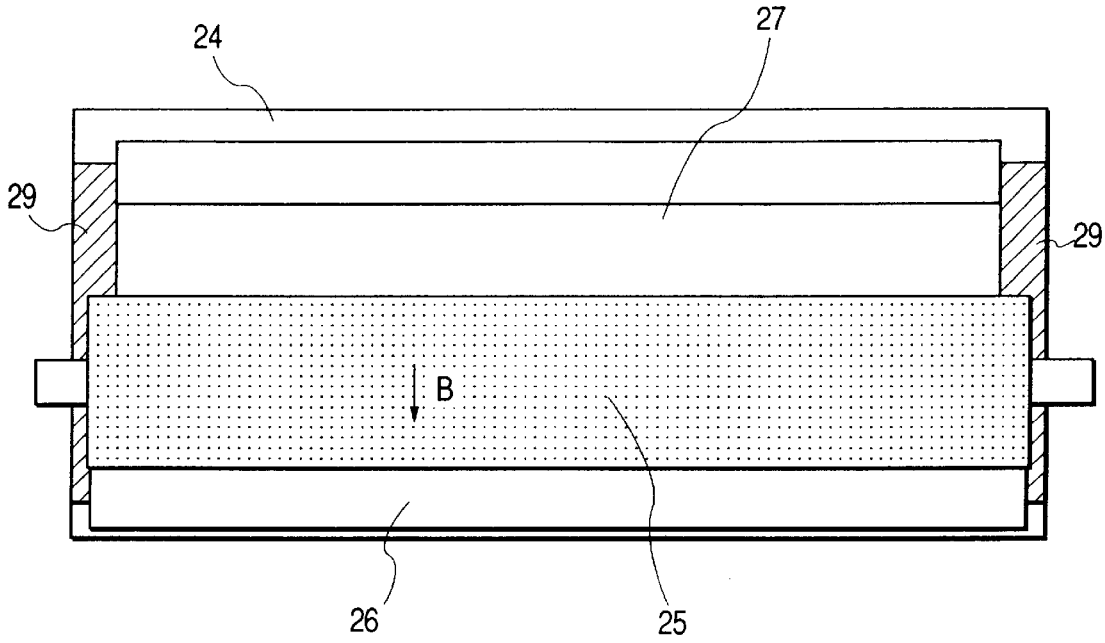
FIG. 8 shows the structure of a developing apparatus.
Figure 9:
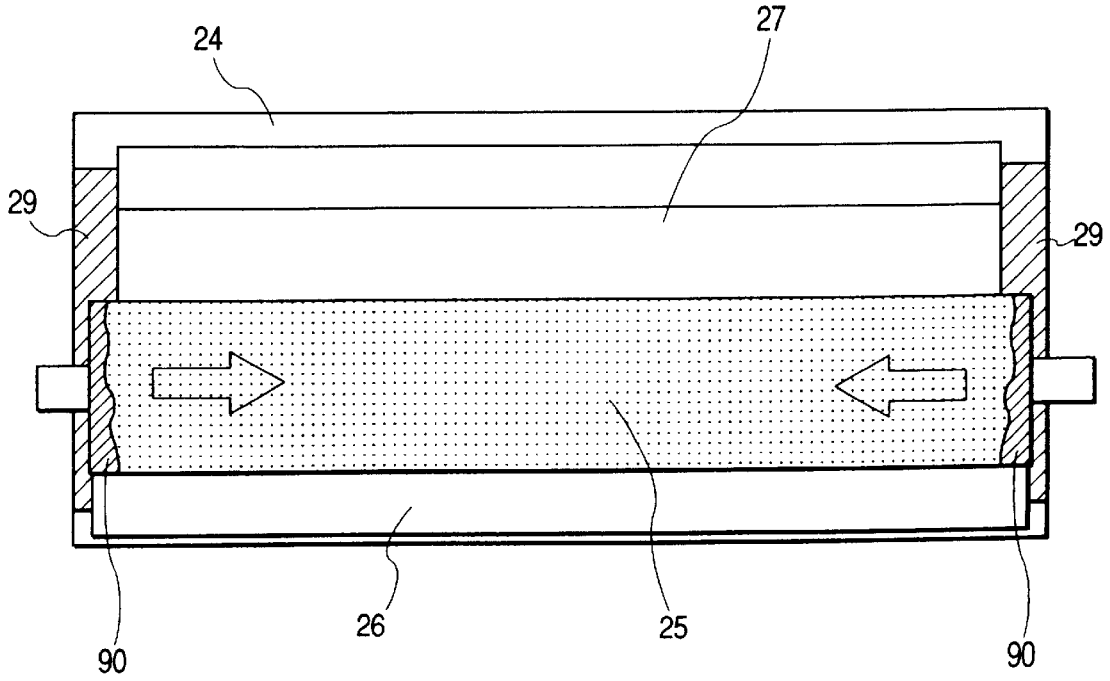
FIG. 9 shows the construction of the developing apparatus.

Here, the end portions of the opening portion of the developing container will be described with reference to FIGS. 7A and 7B. FIGS. 7A and 7B show conceptional views of the developing apparatus according to the present invention. The following description is the description of the end portions of the opening portion of the developing apparatus and therefore, in FIGS. 7A and 7B, the members including the developing roller usually provided in the developing apparatus are not shown.

First, as shown in FIG. 7A, the developing apparatus 72 is provided with an opening portion 71 as the opening portion of the developer container of the present invention. Through this opening portion 71, the developer is carried from the interior to the exterior of the developing apparatus 72. This opening portion 71 is provided from the center to the side portions of the developing apparatus 72.

Accordingly, in this case, the end portions of the opening portion 71 include the side portions of the developing apparatus 72. That is, when the seal members are disposed on the end portions of the opening portion 71, the seal members 73 are disposed on the side portions of the developing apparatus 72, as shown in FIG. 7B.

While the foregoing is the case where the seal members are disposed on the end portions of the opening portion referred to in the present invention, the present invention is not restricted to the case as described above, but the seal members can be disposed on the end portions of opening portions of other various shapes.

Also, in the example shown in FIGS. 7A and 7B, a portion 70 which is a portion forming the opening portion 71 in the developing apparatus 72 is formed by the frame of the developing apparatus 72, whereas the present invention is not restricted to such a case.

For example, the portion 70 which is the portion forming the opening portion 71 may be an elastic blade or other seal members.

Also, since the developer carrying member is the developing roller, the carrying property for the developer can be improved.

Also, the developer carrying member is comprised of a surface layer and at least one underlying layer and therefore, with the close contact property with the seal members taken into account, the sealing property can be more improved.

Figure 3:
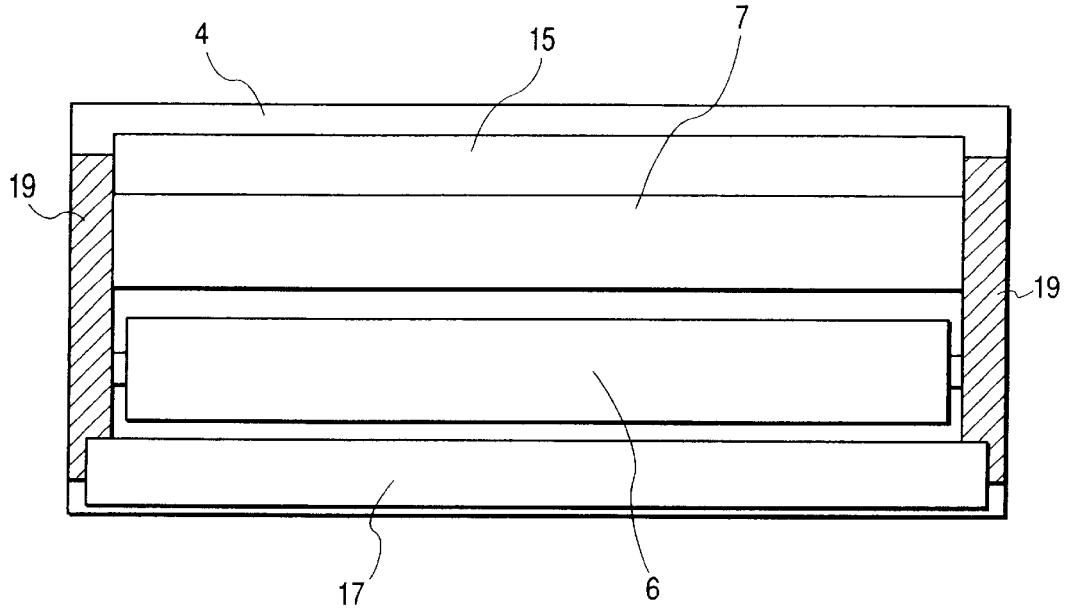
FIG. 3 shows the front structure of the developing apparatus shown in FIG. 1.

Here, reference is had to FIG. 3 to further describe the developing apparatus shown in FIG. 1. FIG. 3 shows the front structure of the developing apparatus shown in FIG. 1.

FIG. 3 is a view of the developing apparatus 4 as it is seen in the direction from the photosensitive drum 1, and the developing roller 5 is not shown therein.

The side surface portions of the end portion seal members 19 are disposed so as to contact with the opposite end surface portions of the elastic blade 7 to thereby prevent the leakage of the toner from the opposite end portions of the elastic blade 7.

The material of the end portion seal members 19 may preferably be a fibrous material such as woolen felt or PTFE pile, or a foamed material such as polyurethane foam or sponge rubber. In the present embodiment, woolen felt is used.

A description will now be made of the developing roller 5 used in the present embodiment. The surface of the developing roller 5 in the present embodiment has a moderate degree of unevenness for heightening the probability of frictional contact with the non-magnetic toner 8, and effecting the carrying of the non-magnetic toner 8 well, and as the developing roller, use is made of an elastic roller 5 comprising two layers, i.e., a silicon rubber layer as an underlying layer, and a surface layer of a urethane material covering the silicon rubber layer.

The surface layer is formed on the silicon rubber layer by dip coating. Also, the hardness of the developing roller 5 is such hardness that becomes 50° when an Asker C hardness meter is weighted by 1 kg.

The developing roller 5 of such low hardness is high in its close contact property with the end portion seal members 19 and therefore it is high in the sealing property to the end portion leakage of the non-magnetic toner 8. Accordingly, the hardness of the developing roller 5 may preferably be within the range of 40° to 60° when the Asker C hardness meter is weighted by 1 kg.

When the above-described developing operation is repeated by the use of the above-described developing roller 5, it is difficult to stably coat the outermost peripheral portion of the end surfaces of the elastic layer during the formation of the surface layer because the surface layer of the developing roller 5 is formed by dip coating, as previously described.

Therefore, if the end portions of the developing roller 5 are on the end portion seal members 19, the peeling-off of the end portions of the surface layer will be caused by the frictional contact between the end portions of the developing roller 5 and the end portion seal members 19.

When the above-described developing operation is further repeated, the peeling-off of the end portions of the surface layer progresses to the lengthwisely central portion of the developing roller 5 and as the result, gaps are created between the end portion seal members 19 and the developing roller 5 and the leakage of the toner occurs.

Figure 4:
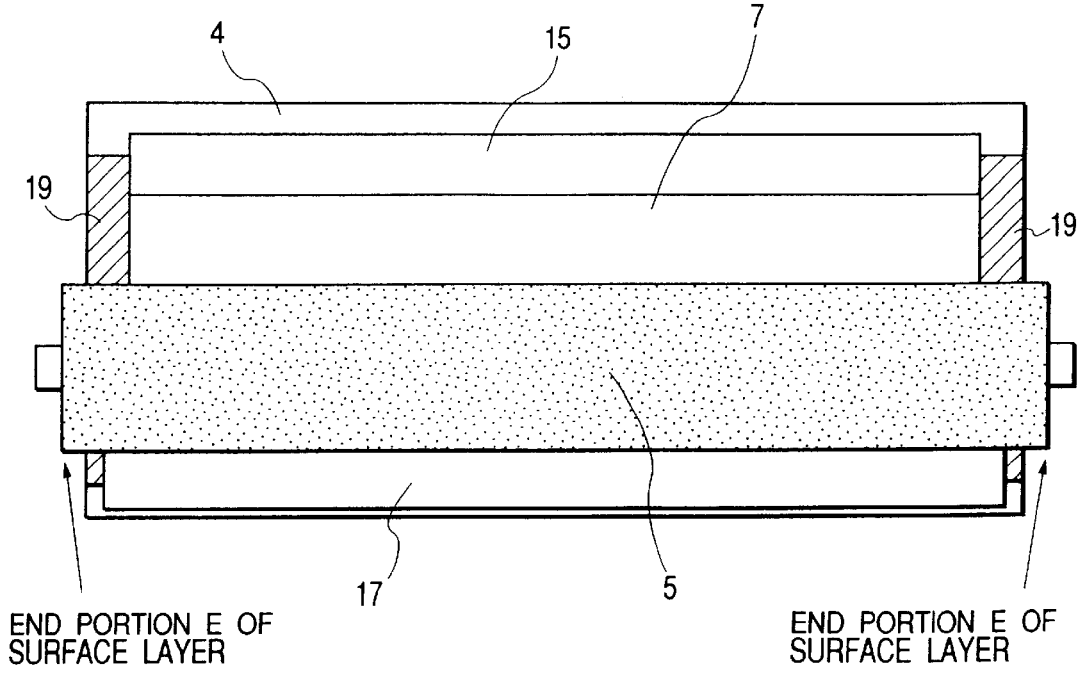
FIG. 4 shows the front structure of the developing apparatus shown in FIG. 1.

So, in the present embodiment, a design is made such that as shown in FIG. 4, the end portions E of the surface layer of the developing roller 5 as the end portions of the developing carrying member of the present invention are outside the opening portion of the developing container and do not contact with the end portion seal members 19. FIG. 4 shows the front structure of the developing apparatus shown in FIG. 1.

By doing so, the end portions E of the surface layer of the developing roller 5 do not frictionally contact with the end portion seal members 19 and therefore, even when the developing operation is repetitively performed, the peeling-off of the end portions is not caused and the peeling-off of the surface layer of the developing roller 5 is not caused, and the seal against the leakage of the non-magnetic toner 8 can be sufficiently kept.

Also, by adopting a construction in which the end portions of the developing roller 5 are outside the opening portion of the developing container and do not contact with the end portion seal members 19, there is no level difference such as seams in the lengthwise direction of the developing roller 5 from the opening portion of the developing container 4 onto the end portion seal members 19, and further by the hardness of the developing roller 5 being set to low hardness, the close contact property heightens in the pressure contact portions of the developing roller 5 with the end portion seal members 19, and the sealing property against the leakage of the non-magnetic toner from the end portions has been more heightened.

While the developing roller 5 used in the present invention is one of a two-layer construction, the effect of the present invention can of course be obtained even when a developing roller of a single layer or three or more layers is used.

Second Embodiment of the Developing Apparatus

A second embodiment of the developing apparatus according to the present invention will now be described. This embodiment is such that the construction of the developing roller as the developer carrying member of the present invention is changed relative to that in the aforedescribed first embodiment.

In the other points, the image forming operation and developing operation of the present embodiment are similar to those of the aforedescribed first embodiment and therefore need not be described.

Figure 5:
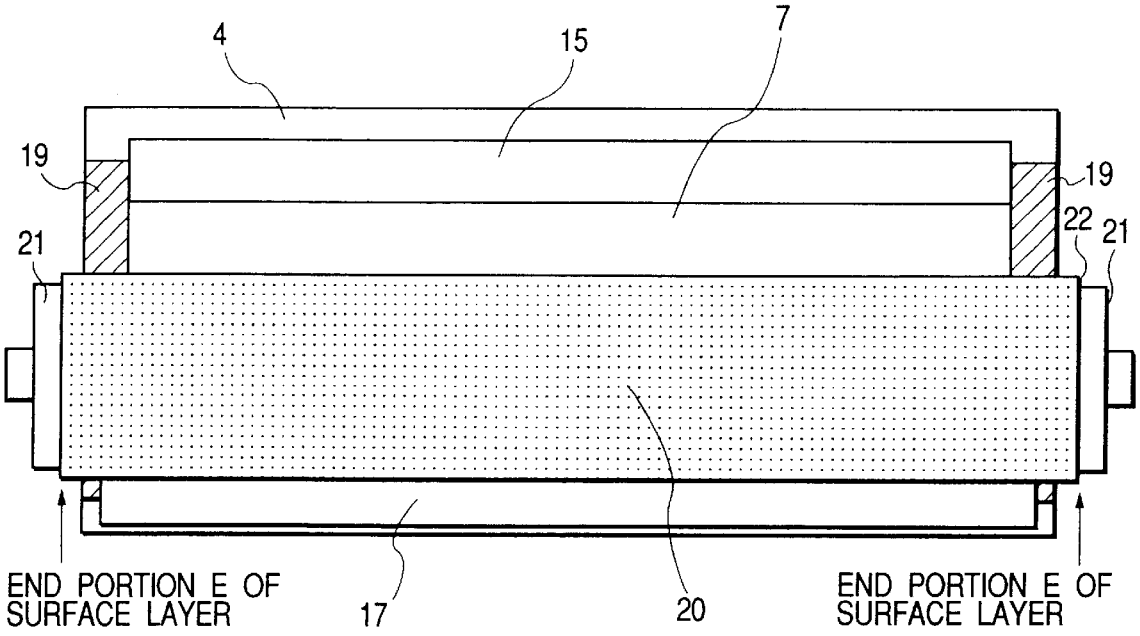
FIG. 5 shows the front structure of a second embodiment of the developing apparatus according to the present invention.

FIG. 5 shows the front structure of the second embodiment of the developing apparatus according to the present invention. As shown in FIG. 5, the developing roller 20 as the developer carrying member of the present invention is comprised of an underlying layer 21 as the underlying layer of the present invention and a surface layer 22 as the surface layer of the present invention.

This second embodiment is characterized in that the opposite end portions of the surface layer 22 of the developing roller 20 are lengthwisely inside the underlying layer 21 which is an elastic layer.

Also, the hardness of the developing roller 20 is 50° (Asker C hardness meter, weighting by 1 kg) in the portion thereof including the surface layer 22. As regards the material of the developing roller 20, the developing roller 20 is an elastic roller comprising two layers, i.e., a silicon rubber layer and a surface layer 22 of a urethane material covering the silicon rubber layer.

The developing roller 20 of such low hardness is high in the close contact property with the end portion seal members 19 and therefore is high in the sealing property against the end portion leakage of the toner. Accordingly, the hardness of the developing roller 20 may preferably be not less than 40° and not more than 60° when the Asker C hardness meter is weighted by 1 kg.

The surface layer 22 is formed on the underlying layer 21 which is an elastic layer by roll coating. When the surface layer is to be applied by roll coating, there is a case where from the viewpoint of the manufacturing method therefor, the surface layer is not sufficiently applied at the beginning and end of application.

If the developing operation is performed by the use of such a developing roller 20, gaps will be created in the end portions of the surface layer of the developing roller 20 and the leakage of the toner will occur.

So, the present embodiment adopts a construction as shown in FIG. 5 wherein the end portions E of the surface layer as the end portions of the developer carrying member of the present invention which are the end portions of the surface layer 22 of the developing roller 20 are disposed outside the opening portion of the developing container.

By adopting such a construction, the end portions E of the surface layer do not abut against the end portion seal members 19 as the seal members of the present invention. By doing so, the end portions E of the surface layer of the developing roller 20 do not frictionally contact with the end portion seal members 19 and therefore, even when the developing operation is repetitively performed, the peeling-off of the end portions is not caused, and the peeling-off of the surface layer of the developing roller 20 does not occur and the sealing against the leakage of the toner is sufficiently maintained.

Also, the end portions E of the surface layer of the developing roller 20 are located outside the opening portion of the developing container and do not abut against the end portion seal members 19 and therefore, there are no level differences such as seams in the lengthwise direction on the developing roller 20 from the opening portion of the developing container onto the end portion seal members 19, and further the hardness of the developing roller 20 is set to low hardness, whereby the close contact property is heightened in the pressure contact portion of the developing roller 20 with the end portion seal members 19, and the sealing property against the end portion leakage of the toner is more heightened.

While the developing roller used in the present invention is of a two-layer construction, of course the effect of the present invention can be obtained even when a developing roller of a single layer or three or more layers is used.

Embodiment of the Process Cartridge

While in the description of each embodiment of the above-described developing apparatus, the developing apparatus has been described as a developing apparatus of such a construction that it is fixed in the main body of the image forming apparatus and supplies only the toner, use may be made of a process cartridge comprising a developing apparatus detachably mountable on the main body of the image forming apparatus.

That is, use may be made of a process cartridge comprising a developing apparatus, a photosensitive drum, a cleaning blade, a waste toner containing container, a charging apparatus, etc. formed integrally with one another and detachably mountable with respect to the main body of the image forming apparatus.

Figure 6:
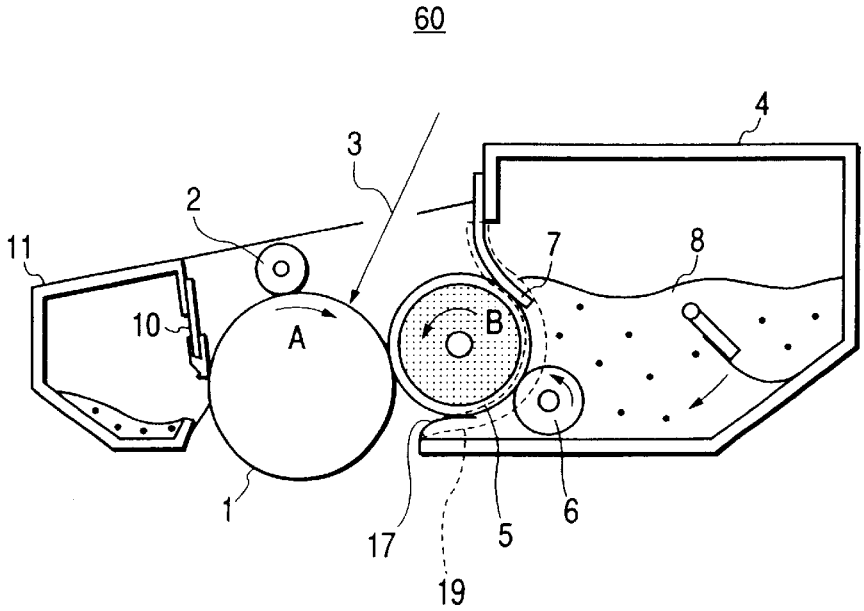
FIG. 6 shows the cross-sectional structure of an embodiment of a process cartridge according to the present invention.

Such a process cartridge will now be described with reference to FIG. 6. FIG. 6 shows the cross-sectional structure of an embodiment of a process cartridge according to the present invention.

As shown in FIG. 6, this process cartridge 60 is provided with a photosensitive drum 1 exposed to a laser beam 3, a charging roller 2, a developing apparatus 4 containing a non-magnetic toner 8, and a waste toner containing container 11 provided with a cleaning blade 10 as main members.

Also, the developing apparatus 4 is provided with a developing roller 5 as the developer carrying member of the present invention similar to one used in the aforedescribed first embodiment of the developing apparatus according to the present invention, an elastic roller 6, an elastic blade 7, a seal member 17 and end portion seal members 19 as the seal members of the present invention.

The operations of these members are similar to the operations of the aforedescribed first and second embodiments of the developing apparatus according to the present invention and therefore need not be described. Also in the process cartridge shown in FIG. 6, the end portion seal members 19 are disposed so as to abut against the other portions than the end portions of the developing roller 5.

In the developing apparatus shown in FIG. 6, however, as the developing roller, not only use may be made of the developing roller 5 used in the aforedescribed first embodiment of the developing apparatus according to the present invention, but also use may be made of the developing roller 20 used in the aforedescribed second embodiment of the developing apparatus according to the present invention.

Thus, again in an embodiment of the process cartridge according to the present invention, there can be obtained an effect similar to that of the aforedescribed first and second embodiments of the developing apparatus according to the present invention and also, the convenience to the user can be further improved because the developing apparatus 4 is formed integrally with the photosensitive drum 1, etc.

Embodiment of the Image Forming Apparatus

An embodiment of an image forming apparatus according to the present invention will now be described. The embodiment of the image forming apparatus according to the present invention is an embodiment provided with the first embodiment or the second embodiment of the developing apparatus according to the present invention or an embodiment of the process cartridge.

That is, this image forming apparatus is an image forming apparatus provided with image forming means for reading the image of an original, and effecting image formation on a sheet material by the developing apparatus or the process cartridge shown as the first embodiment or the second embodiment or an embodiment, on the basis of the read image information. Also, as apparatuses to which the embodiment of the image forming apparatus according to the present invention is applied, mention can be made of a printer, a facsimile apparatus, a copier, etc.

Accordingly, in the embodiment of the image forming apparatus according to the present invention, there can be obtained an effect similar to that of the aforedescribed first and second embodiments of the developing apparatus according to the present invention and an embodiment of the process cartridge according to the present invention.

As described above, according to the present invention, the seal members abut against the other portions than the end portions of the developer carrying member and therefore, the end portions of the developer carrying member are not frictionally contacted by the seal members and thus, the peeling-off of the developer carrying member can be prevented and it becomes possible to prevent the leakage of the developer.

Also, when the developer carrying member is formed by a developing roller, level differences can be easily eliminated in the lengthwise direction of the developer carrying member from the opening portion of the developing container onto the seal members and therefore, the sealing property against the leakage of the developer is further improved.

Also, the developer carrying member is constituted by a plurality of layers such as the surface layer and one or more underlying layers and thus, there can be provided a construction which takes into account the close contact property with the seal members, and the sealing property can be more improved.

Also, the surface layer is formed by dip coating or roll coating and therefore, the developing nip can be secured by various kinds of coating, and the recovering property to a compressive force can be maintained and a desired charging polarity and charging amount can be obtained, and the developer carrying member is excellent in the releasing property with respect to the developer, and can restrain the filming of the developer.

Also, the seal members are disposed inside the lengthwise end portions of the developer carrying member and therefore, for example, even when the developer carrying member is constituted by a plurality of layers, the end portions of at least the surface layer do not abut against the seal members and thus, the sealing property between the developer carrying member and the seal members can be improved.

Also, since the hardness of the developer carrying member is within the range of 40° to 60° as measured when the Asker C hardness meter is weighted by 1 kg, the close contact property between the developer carrying member and the seal members heightens, and the sealing property against the leakage of the developer can be improved.

Also, since the seal members are formed of woolen felt, PTFE pile or other fibrous material, or polyurethane foam, sponge rubber or other foamed material, the seal members can be formed more easily.

Also, the process cartridge is a process cartridge provided with the developing apparatus according to the present invention, and detachably mountable on an apparatus in which the developer is carried by this developing apparatus and therefore, the convenience to the user can be further improved.

While the embodiments of the present invention have been described above, the present invention is not restricted to these embodiments, but all modifications within the technical idea of the invention are possible.

What is claimed is:

1. A developing apparatus comprising:

a developing container for containing a developer therein;

a developer carrying member, provided in an opening portion of said developing container, for developing an electrostatic image on an image bearing member, said developer carrying member having a rubber layer and a surface layer formed on said rubber layer; and a seal member provided in the opening portion for preventing leakage of the developer from an end portion of the opening portion, wherein said seal member is in contact with said surface layer except for an end edge of said surface layer.

2. A developing apparatus according to claim 1, wherein said rubber layer is silicon rubber, and said surface layer is urethane.

3. A developing apparatus according to claim 1, wherein said surface layer is formed by dip coating.

4. A developing apparatus according to claim 1, wherein said surface layer is formed by roll coating.

5. A developing apparatus according to claim 1, wherein a hardness of said developer carrying member is not less than 40° and not more than 60° in Asker C 10 hardness.

6. A developing apparatus according to claim 1, wherein said seal member is a woolen felt material.

7. A developing apparatus according to claim 1, wherein said seal member is a PTFE pile material.

8. A developing apparatus according to claim 1, wherein said seal member is a foam material.

* * * * *